United States Patent [19]

Yoshinori et al.

[11] Patent Number: 4,889,220

[45] Date of Patent: Dec. 26, 1989

[54] AUTOMATIC MONEY DEPOSITING APPARATUS

[75] Inventors: Koshida Yoshinori; Isobe Minoru; Suto Shin-ichi, all of Tokyo, Japan

[73] Assignee: Oki Electric Industry Co., Ltd., Tokyo, Japan

[21] Appl. No.: 77,864

[22] Filed: Jul. 27, 1987

[30] Foreign Application Priority Data

Aug. 6, 1986 [JP] Japan ..... 61-183299
Oct. 21, 1986 [JP] Japan ..... 61-248328

[51] Int. Cl.[4] ..... G07F 7/04

[52] U.S. Cl. ..... 194/206; 209/534; 235/379

[58] Field of Search ..... 194/206, 207; 209/534; 235/379

[56] References Cited

U.S. PATENT DOCUMENTS 4,479,049 10/1984 Hirose ..... 194/206 X
4,625,870 12/1986 Nao et al. ..... 235/379 X
4,744,468 5/1988 Goi et al. ..... 194/206 X

FOREIGN PATENT DOCUMENTS 58-140890 8/1983 Japan .

*Primary Examiner*—F. J. Bartuska
*Attorney, Agent, or Firm*—Wenderoth, Lind & Ponack

[57] ABSTRACT

An automatic money depositing apparatus includes a customer access panel having a receiver slot for receiving moneys deposited by a customer and a return slot for returning moneys deposited by the customer; a separator/feeder for separating and feeding the moneys one by one which have been received through the receiver slot; a discriminator for checking whether the moneys fed by the separator/feeder are true or false and identifying the demoninations of the moneys; wherein the separator/feeder and the discriminator are disposed behind the customer access panel. A temporary storage unit for temporarily storing true and false moneys separately is located adjacent to the return slot. A money container stores the true moneys delivered from the temporary storage unit. Input keys are operated by the customer to indicate approval or nonapproval of a money deposit made by the customer through the receiver slot. A control unit is responsive to operation of the input keys indicative of a nonapproval of the money deposit for opening the return slot to allow the customer to remove the moneys directly from the temporary storage unit. When trouble occurs prior to operation of the input keys, the receiver and return slots are opened to give the customer access to the moneys in the apparatus. The return slot is openable to different degrees dependent on whether only the false moneys or all of the deposited moneys are to be removed from the temporary storage unit.

3 Claims, 7 Drawing Sheets

AUTOMATIC MONEY DEPOSITING APPARATUS

BACKGROUND OF THE INVENTION

1. Field of the Invention:

The present invention relates to an automatic money depositing apparatus for use in a banking facility such as a bank for depositing bank notes or paper currencies, and more particularly to such an automatic money depositing apparatus for discriminating bank notes that have been deposited by a customer, then temporarily storing the bank notes in a temporary storage unit, waiting for customer's instructions as to monetary transaction, and effecting a subsequent process according to the customer's instruction.

2. Description of the Prior Art:

Automatic transaction machines used in banking facilities such as banks include a money depositing machine for depositing bank notes under the direction of a customer. When cash such as bank notes is deposited by a customer into the automatic money depositing machine, the bank notes are delivered one by one to a discriminator which ascertains whether the deposited bank notes are true or false, and the discriminated bank notes are divided and temporarily stored as true and false bank notes. Then, the sum of money represented by the true bank notes, i.e, the paper money that can be accepted, is indicated to the customer, and any false bank notes put into the machine are returned to the customer. A subsequent process will be effected with respect to the true bank notes under the direction of the customer. More specifically, if the customer gives instructions for transaction approval, then the acceptable bank notes are sorted out and stored in bank note containers according to their denominations. If the customer does not with monetary transaction, then the acceptable bank notes are returned to the customer.

One such automatic monetary transaction machine is disclosed in Japanese Laid-Open Patent Publication No. 58(1983)-140890. FIG. 8 of the accompanying drawings illustrates the disclosed machine in sectional side elevation.

The automatic monetary transaction machine has a housing 1 accommodating therein various components described below, constituting automatic money depositing and dispensing apparatus. A bank note receiver 2 for receiving bank notes deposited by a customer is located inwardly of a bank note receiving slot defined in an upper portion of the housing 1 and having an openable shutter.

A bank note separator/feeder 3 is disposed directly below the bank note receiver 2 and has a suction drum 4 for separating, under suction, the bank notes delivered from the bank note receiver 2 and feeding them one by one.

The housing 1 also houses therein a bank note discriminator 5 having an optical sensor, a magnetic sensor, and a discriminating circuit (not shown) for checking whether the bank notes from the separator/feeder 3 are true or false, whether they are damaged or not, for identifying the denominations of the bank notes to be deposited and dispensed, and for counting the amount of money represented by the bank notes and a temporary storage unit 9 for storing false bank notes. These finned wheels 6, 7 and the temporary storage units 8, 9 are positioned in an upper portion of the housing 1. Those bank notes which have been discriminated as true bank notes are delivered by the finned wheel 6 into the true bank note storage unit 8, and those bank notes which have been discriminated as false bank notes are delivered by the finned wheel 7 into the false bank note storage unit 9.

The housing 1 accommodates in a lower portion thereof a money container 10 for storing bank notes of one denomination, e.g., 1,000 a money container 11 for storing bank notes of another denomination, e.g., 10,000, a money container 12 for storing deposited bank notes which have been judged as damaged bank notes by the discriminator 5, and a reject money container 13 for storing bank notes which have been judged as unacceptable bank notes upon denomination identification by the discriminator 5 and upon detection by a sensor (not shown) of two stacking bank notes when bank notes are to be dispensed.

Finned wheels 14, 15, 16, 17, are disposed respectively above the money containers 10, 11, 12, 13, for stacking bank notes in these money containers 10, 11, 12, 13.

A suction drum 18 is combined with the finned wheel 14 for separating and feeding bank notes one by one from the money container 10. Another suction drum 19 is combined with the finned wheel 15 for separating and feeding bank notes one by one from the money container 11.

The various components as described above housed in the housing 1 are interconnected by a feed path 20 comprising feed rollers, feed belts, and swingable blades for changing feed rollers, feed belts, and swingable blades for changing the direction of feed of bank notes.

The automatic monetary transaction machine shown in FIG. 8 operates as a money depositing apparatus as follows: Bank notes placed into the bank note receiver 2 by a customer are delivered to the bank note separator/feeder 3 and separated and fed one by one by the suction drum 4 along the feed path 20 into the bank note discriminator 5. The bank note discriminator 5 checks if the bank notes are true or false, identifies the denominations of the bank notes, counts the amount of money represented by the bank notes, and checks if the bank notes are damaged or not. Any bank notes which are judged as false bank notes are fed along the feed path 20 toward the finned wheel 7, by which they are stacked in the temporary storage unit 9. The bank notes which are judged as true bank notes are supplied via the feed path 20 to the finned wheel 6, by which they are stacked in the temporary storage unit 8.

After all of the deposited bank notes are stored in the temporary storage units 8, 9, the sum of money represented by the true bank notes that can be accepted is indicated on a display (not shown), and the false bank notes are fed from the temporary storage unit 9 along the feed path 20 back to the bank note receiver 2 for return to the customer.

The customer is then required to make a decision as to whether monetary deposit is approved of or not, and gives instructions for approval or nonapproval through an instructions input unit (not shown).

If the customer gives instructions for transaction approval, then the true bank notes stored in the temporary storage unit 8 are delivered via the feed path 20 through the temporary storage unit 9 and the bank note receiver 2 to the separator/feeder 3. Thereafter, the true bank notes are separated and fed one by one by the suction drum 4 along the feed path 20 to the discriminator 5 again.

The discriminator 5 then checks if the bank notes are damaged or not and also identifies their denominations, after which the bank notes are fed along the feed path 20 to the finned wheels 14, 15 and/or 16, by which the bank notes are stacked in the money containers 10, 11 and/or 12.

If the customer gives nonapproval instructions for money deposit, then the bank notes go from the temporary storage unit 8 via the feed path 20 through the temporary storage unit 9 into the bank note receiver 2 for return to the customer.

With the conventional automatic money depositing machine, the true bank notes which have temporarily been stored have to be separated, fed, and discriminated again, and hence are quite likely to get jammed or subjected to other troubles. Should the bank notes suffer some trouble in the machine, it will take a long period of time for the machine to return the bank notes to the customer who still has a claim for the return of the money. As a result, the downtime of the machine is increased affecting the business of the bank and making the service for the customer slow.

More specifically, as described above, bank notes deposited in the bank note receiver 2 are separated and fed one by one, and checked to discriminate true bank notes from false bank notes. The true and false bank notes are divided and stored in their respective temporary storage units 9, 8. Upon customer's instructions for transaction approval, the true bank notes are separated and fed one by one again, and their denominations are identified again, after which the bank notes are stored in the money containers 10, 11, 12. Therefore, the bank notes have to be separated and fed twice, a process which is relatively easily susceptible to trouble such as a bank note jam. Since the bank notes must be fed along the feed path which is long, it is quite often for the bank notes to get involved in trouble during delivery along the feed path.

At the time the customer issues instructions for transaction approval or nonapproval, the bank notes are stored in the temporary storage unit and hence are not accessible by the customer. When trouble such as a bank note jam occurs after bank notes have been placed in the machine, the machine becomes inoperative while the bank notes which the customer still has a claim for the return of remains trapped in the machine owned by the bank. In order to get the machine operative and return the bank notes to the customer, the machine must be attended by an operator from the bank, resulting in a long period of time until the bank notes are returned to the customer.

Trouble such a bank note jam may happen while the bank notes are being fed from the temporary storage unit toward the bank note receiver after the customer has instructed the machine to cancel monetary deposit. In this case, too, a long period of time is required for the customer to have the bank notes returned since the machine stops and must be attended by an operator.

When the above trouble occurs, the downtime of the machine is increased resulting in an obstacle to banking business and inconvenience to customers.

Another problem is that the shutter at the bank note receiver 2 opens in the same manner irrespective of whether only false bank notes are returned or all bank notes deposited are returned under the direction of the customer. Therefore, the customer cannot tell, from the manner in which the shutter opens, whether only false bank notes are returned or all bank notes deposited are returned.

SUMMARY OF THE INVENTION

In view of the aforesaid drawbacks of the conventional automatic money depositing machine, it is an object of the present invention to provide an automatic money depositing apparatus in which bank notes are less subjected to a bank note jam, and any trouble leading to an obstacle to banking note jam, and any trouble leading to an obstacle to banking business and inconvenience to customers is minimized, and which has means for enabling customers to easily know that only false bank notes or all bank notes are returned.

According to the present invention, there is provided an automatic money depositing apparatus comprising a customer access panel having a receiver slot for receiving moneys deposited by a customer and a return slot for returning moneys deposited by the customer, separator/feeder means for separating and feeding the moneys one by one which have been received through the receiver slot, discriminator means for checking whether the moneys fed by the separator/feeder means are true or false and identifying denominations of the moneys, the separator/feeder means and the discriminator means being disposed behind the customer access panel, a temporary storage unit for temporarily storing true and false moneys separately, the temporary storage unit being located adjacent to the return slot, a money container for storing the true moneys delivered from the temporary storage unit, input means operable by the customer to indicate approval or nonapproval of a money deposit made by the customer through the receiver slot, and control means responsive to operation of the input means indicative of nonapproval of the money deposit for opening the return slot to allow the customer to remove the moneys directly from the temporary storage unit.

The control means is arranged to open at least the receiver slot and the return slot to allow the customer to remove the deposited moneys when trouble occurs in the apparatus prior to operation of the input means.

The automatic money depositing apparatus also includes a first shutter for selectively opening and closing the receiver slot and a second shutter for selectively opening and closing the return slot, and the control means is arranged for automatically opening the second shutter to a first degree to return only the false moneys from the temporary storage unit through the return slot to the customer, and for opening the second shutter to a second degree different from the first degree to return all the deposited moneys from the temporary storage unit through the return slot to the customer in response to operation of the input means indicative of nonapproval of the money deposit.

When the customer operates the input means to indicate approval of the money deposit, the true moneys are stored directly from the temporary storage unit into the money container. Therefore, the deposited moneys may be fed and discriminated only once before the true moneys are stored in the money container. This is advantageous in that the deposited moneys are not required to be fed and discriminated twice, as is the case with the conventional apparatus, and hence are less liable to suffer a jam in the apparatus. The discriminator means and the separator/feeder means are interconnected directly or a short feed path, so that the moneys are also less subject to a jam. Once the moneys are stored in the money container, therefore, they are substantially free of the danger of a jam.

When the customer operates the input means to indicate nonapproval of the money deposit, the return slot is opened so that the customer can remove the deposited moneys directly from the temporary storage unit.

Should a jam occur in the apparatus prior to operation of the input means to indicate approval or nonapproval by the customer of the money deposit, at least the receiver and return slots are opened to allow the customer himself to remove the deposited moneys from the apparatus. Accordingly, the deposited moneys can quickly be retrieved by the customer without waiting for the assistance of a bank clerk, and any downtime of the apparatus is substantially eliminated or shortened, so that the bank business will not be obstructed and any inconvenience to the customer will be minimized.

For returning only the false moneys out of all the deposited moneys, the second shutter is opened to the first degree to expose only a portion of the temporary storage unit. For returning all the deposited moneys, the second shutter is opened to the second degree to fully expose the temporary storage unit. Consequently, whether only the false moneys or all the deposited moneys are returned can easily be known to the customer from the manner in which the second shutter is opened. Therefore, the customer can operate the apparatus with increased ease.

The automatic money depositing apparatus of the invention has less complex feed path but can function more effectively than the conventional automatic money depositing apparatus. The apparatus of the invention is therefore highly cost-effective and less free of trouble, and can find wide use in banking services.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
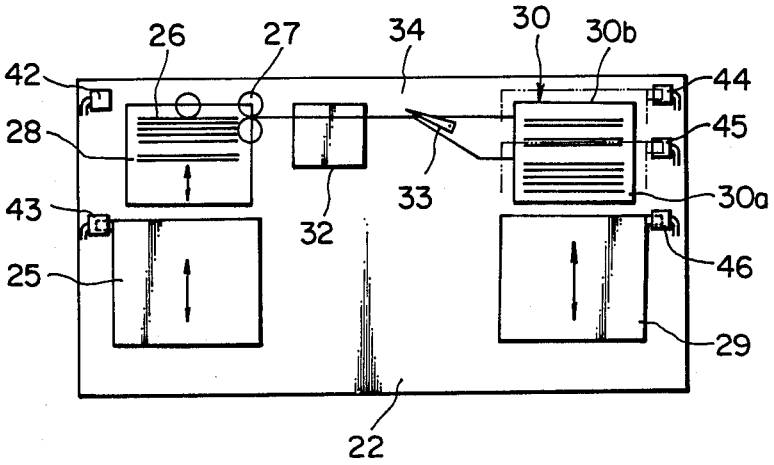
FIG. 1 is a schematic plan view of an automatic money depositing apparatus according to the present invention.
Figure 2:
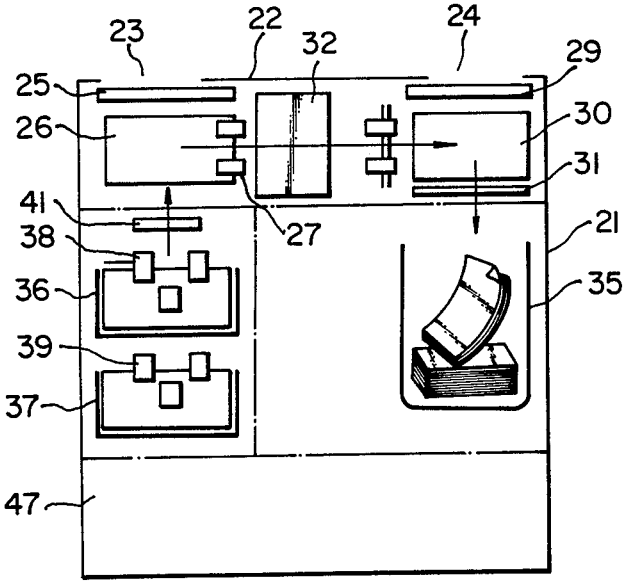
FIG. 2 is a schematic front elevational view showing the internal structure of the automatic money depositing apparatus shown in FIG. 1.

FIGS. 1 and 2 show an automatic money depositing apparatus according to the present invention, which is combined with an automatic money dispensing apparatus.

As shown in FIGS. 1 through 4, the automatic money depositing apparatus includes a housing 21 has a customer access panel 22 in its upper portion, which has a receiver slot 23 for receiving cash or bank notes deposited by a customer and a return slot 24 for returning bank notes to a customer. The housing 21 accommodates therein various components as described below.

An openable shutter 25 is disposed in the receiver slot 23, and a money stocker 26 is located immediately below the receiver slot 23 for stocking bank notes in vertical condition. The money stocker 26 has a separator/feeder 27 (FIGS. 1 and 2) comprising a suction drum or a pickup roller, a feed roller, and a reverse roller for separating and feeding received bank notes one by one, and a bank note presser 28 (FIGS. 1 and 4) movable in the directions of the arrows for holding bank notes which are separated and fed by the separator/feeder 27 and delivered into the money stocker 26 from a feed path (described later) so that the bank notes are prevented from falling or being scattered.

Figure 3:
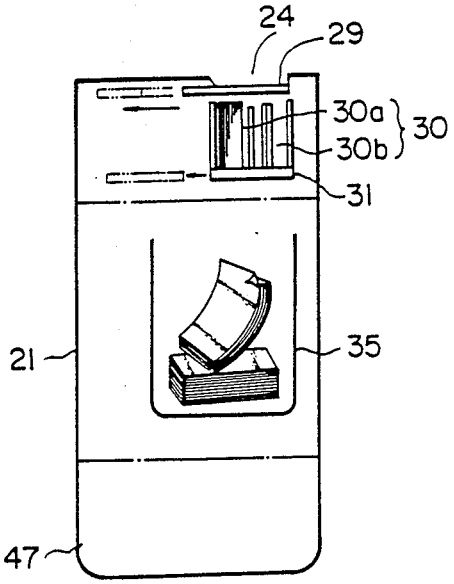
FIG. 3 is a schematic side elevational view of the automatic money depositing apparatus, showing a return slot.

An openable shutter 29 is disposed in the return slot 24, and a temporary storage unit 30 is disposed immediately below the return slot 24 for temporarily storing bank notes in vertical condition. As shown in FIGS. 1 and 3, the temporary storage unit 30 comprises storage chambers 30*a*, 30*b* divided by a partition or the like for storing true and false bank notes, respectively, therein, the temporary storage unit 30 having a bottom plate 31 (FIGS. 2 and 3) that is openable in the direction of the arrow.

The housing 21 also houses therein a bank note discriminator 32 (FIGS. 1 and 2) disposed between the money stocker 26 and the temporary storage unit 30 for checking whether bank notes are true or false, and damaged or not, for checking bank notes for their denominations, for computing the sum of money represented by bank notes, and for counting the number of bank notes.

As shown in FIG. 1, the bank note discriminator 32 and the separator/feeder 27 are interconnected directly or a short feed path, and the bank note discriminator 32 and the temporary storage unit 30 are interconnected by a short feed path 34 composed of feed rollers, feed belts, and a swingable switching blade 33. The separator/-feeder 27, the bank note discriminator 32, the feed path 34, and the temporary storage unit 30 are disposed along the reverse side of the customer access panel 22.

As shown in FIGS. 2 and 3, a money container 35 for storing deposited bank notes is disposed below the temporary storage unit 30, the money container 35 having a bank note inlet opening below the temporary storage unit 30 and confronting the bottom plate 31 as it is in the closed position.

Figure 4:
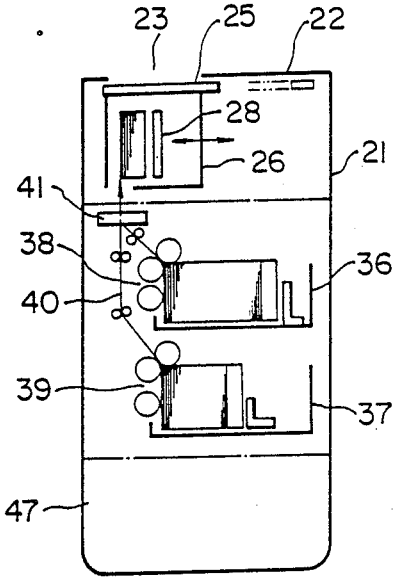
FIG. 4 is a schematic side elevational view of the automatic money depositing apparatus, showing a receiver slot.

As shown in FIGS. 2 and 4, money containers 36, 37 for storing bank notes to be dispensed are disposed below the money stocker 26, with money container 36 over the money container 37. The money container 36, 37 serve to store bank notes of different denominations, i.e., 1,000 and 10,000, or bank notes of one denomination at a doubled capacity.

The money containers 36, 37 have bank note outlets associated respectively with bank note feeders 38, 39 each comprising a suction drum or a pickup roller, a feed roller, and a reverse roller. Bank notes separated and fed one by one from the money containers 36, 37 by the respective bank note feeder 38, 39 are delivered via a feed path 40 (FIG. 4) comprising feed rollers and feed belts into the money stocker 26 through an auxiliary bank note discriminator 41 which confirm bank notes to be dispensed on their way along the feed path 40.

As illustrated in FIG. 1, shutter sensors 42, 43 are disposed behind the customer access panel 22 in spaced-apart relation for detecting the position of the shutter 25, i.e., whether the shutter 25 is opened or closed. Shutter sensors 44, 45, 46 are also disposed behind the customer access panel 22 in spaced-apart relation for detecting the position of the shutter 29, i.e., whether the shutter 29 is closed or partly opened to open the storage chamber 30*b* only, or fully opened to open both the storage chambers 30*a*, 30*b*.

The automatic money depositing apparatus according to the present invention comprises the components described above which are designated by the reference numerals 22 through 35 and 42 through 46, and the automatic money dispensing apparatus combined therewith comprises the components described above which are designated by the reference numerals 36 through 41. The components 22 through 36, 42 and 43 are shared by the automatic money depositing apparatus and the automatic money dispensing apparatus.

The housing 21 also accommodates in its lower portion a control unit 47 for controlling the automatic money depositing apparatus and the automatic money dispensing apparatus, and a power supply (not shown).

Although not shown in FIGS. 1 through 4, the housing 21 further houses therein a sensor for detecting bank notes in the money stocker 26, and sensors for detecting bank notes in the temporary storage unit 30, and sensors for detecting bank notes fed from the money containers 36, 37 by the respective bank note feeders 38, 39. These sensors may be conventional optical sensors.

Figure 5:
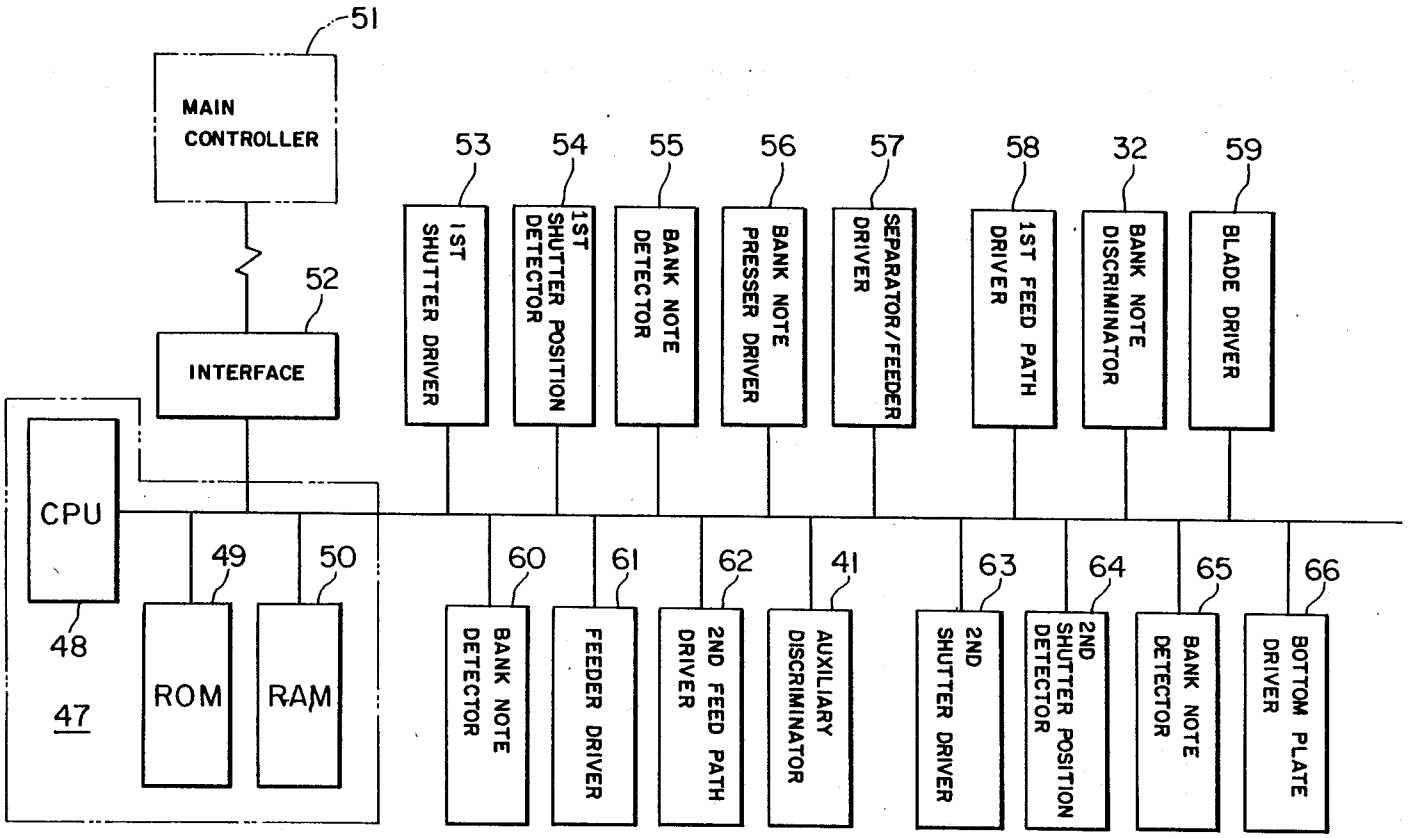
FIG. 5 is a block diagram of a control unit and various components controlled by the control unit in the automatic money depositing apparatus.

FIG. 5 shows in block form the control unit 47 and various drivers controlled by the control unit 47. The control unit 47 comprises a central processing unit (hereinafter referred to as a "CPU") 48, a read-only memory (hereinafter referred to as a "ROM") 49 for storing a control program for controlling money depositing and dispensing processes, and a random-access memory (hereinafter referred to as a "RAM") 50 for temporarily storing various data items. The control unit 49 is connected by an interface 52 to a main controller 51 which controls an entire automatic monetary transaction machine including a card reader, a unit for making an entry on a passbook, and other units.

To the control unit 47, there are connected a first shutter driver 53 for driving the shutter 25 in the receiver slot 23, a first shutter position detector 54 for detecting the position of the shutter 25 based on signals from the sensors 42, 43, a bank note detector 55 for detecting whether there is a bank note or not in the money stocker 26 in the money stocker 26, a separator/-feeder driver 57 for driving the separator/feeder 27, a first feed path driver 58 for driving the feed path 34, and a blade driver 59 for driving the swingable switching blade 33. The control unit 47 is also connected to a bank note detector 60 for detecting whether bank notes are fed by the bank note feeders 38, 39 based on signals from the sensors (not shown), a feeder driver 61 for driving the bank note feeders 38, 39, a second feed path driver 62 for driving the feed path 40, a second shutter driver 63 for driving the shutter 29 in the return slot 24, a second shutter position detector 64 for detecting the position of the shutter 29 based on signals from the sensors 44 through 46, a bank note detector 65 for detecting whether there is a bank note in the temporary storage unit 30 based on a signal from the sensor (not shown), and a bottom plate driver 66 for driving the bottom plate 31 of the temporary storage unit 30. The bank note discriminator 32 and the auxiliary bank note discriminator 41 are also coupled to the control unit 47.

Figure 6:
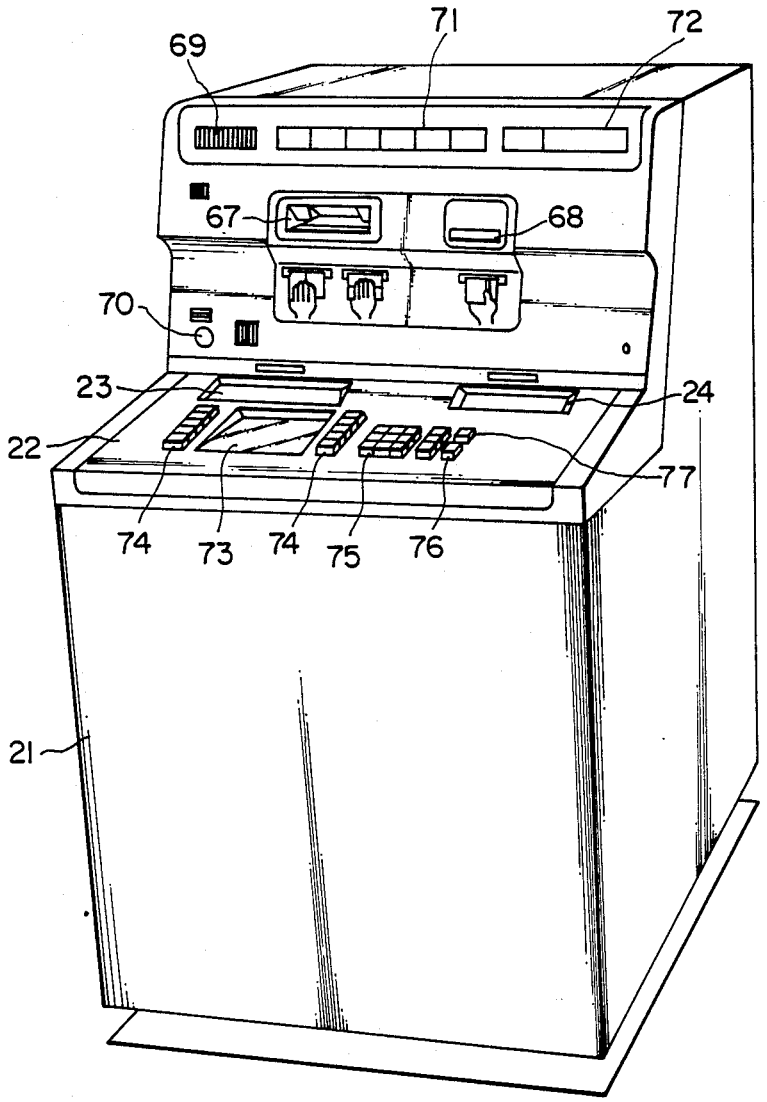
FIG. 6 is a perspective view of an automatic monetary transaction machine incorporating the automatic money depositing apparatus of the invention therein.

FIG. 6 shows in perspective the automatic monetary transaction machine incorporating the automatic money depositing and dispensing apparatus of the above structure. The customer access panel 22 has the receiver slot 23 and the return slot 24 and also has or supports other components as described below.

The customer access panel 22 has a passbook slot 67 for inserting a passbook into and returning a passbook from the machine. Behind the passbook slot 67, there is disposed a unit for making an entry on an inserted passbook. More specifically, when a passbook is inserted through the passbook slot 67 by a customer, the unit makes an entry on the inserted passbook with respect to a monetary deposit. After the monetary deposit has been completed, the passbook is returned through the passbook slot 67 to the customer.

The customer access panel 22 also has a cash card slot 68 for inserting a cash card into and returning a cash card from the machine. The machine includes a card reader disposed behind the cash slot 68 for reading data on a cash card which has been inserted through the cash card slot 68.

An interphone terminal 69 is mounted on the customer access panel 22. The interphone terminal 69 is used for communication with a bank clerk by depressing a personal call key 70 positioned below the interphone terminal 69.

The customer access panel 22 also has a monetary transaction mode indicator 71 for indicated a selected one of various monetary transaction modes such as of "withdrawal", "passbook entry", "cash deposit", and the like. A machine condition indicator 72 is disposed near the monetary transaction mode indicator 71 for indicating the present condition of the machine, i.e., whether the machine is in operation or not.

A sequence guidance indicator 73 comprises a CRT display for successively indicating operation steps for the customer. The customer can depress various keys (described below) by following an operation sequence displayed on the sequence guidance indicator 73. The sequence guidance indicator 73 may include a suitable audio output device for giving audible guidance.

The keys include transaction mode selector keys 74 for indicating a cash deposit or withdrawal or the like, and numeric keys 75 in the form of a ten-key pad for entering a password and the amount of money to be withdrawn. A confirmation key 76 on the customer access panel 22 can be depressed when a money depositing transaction should be continued without canceling, and a cancellation key 77 on the customer access panel 22 can be depressed when a monetary transaction should be canceled. These keys 76, 77 are used as input means for a customer to indicate monetary transaction approval and nonapproval.

Figure 7A:
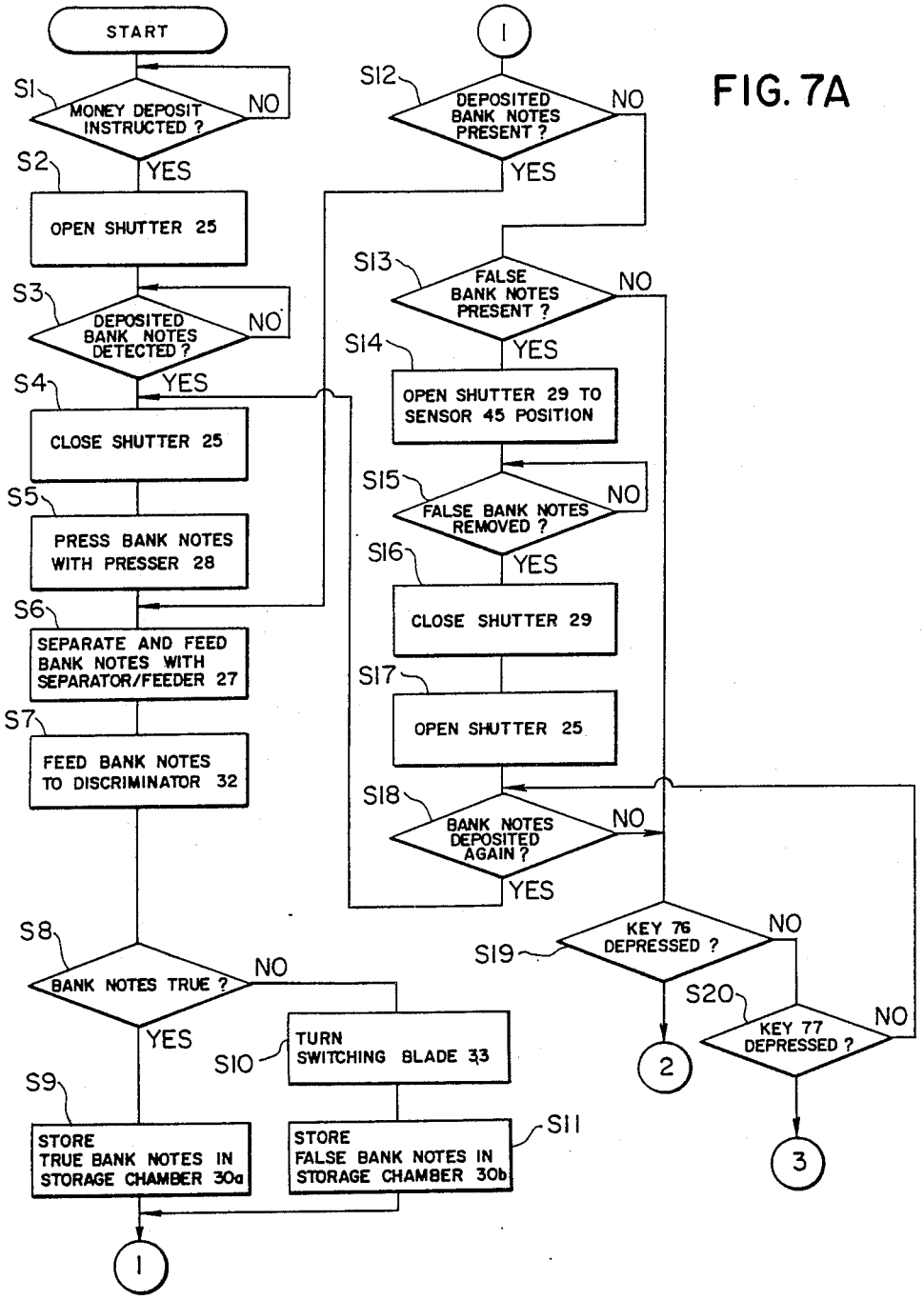
FIGS. 7A and 7B are a flowchart of an operation sequence of the automatic money depositing apparatus in accordance with the present invention.
Figure 7B:
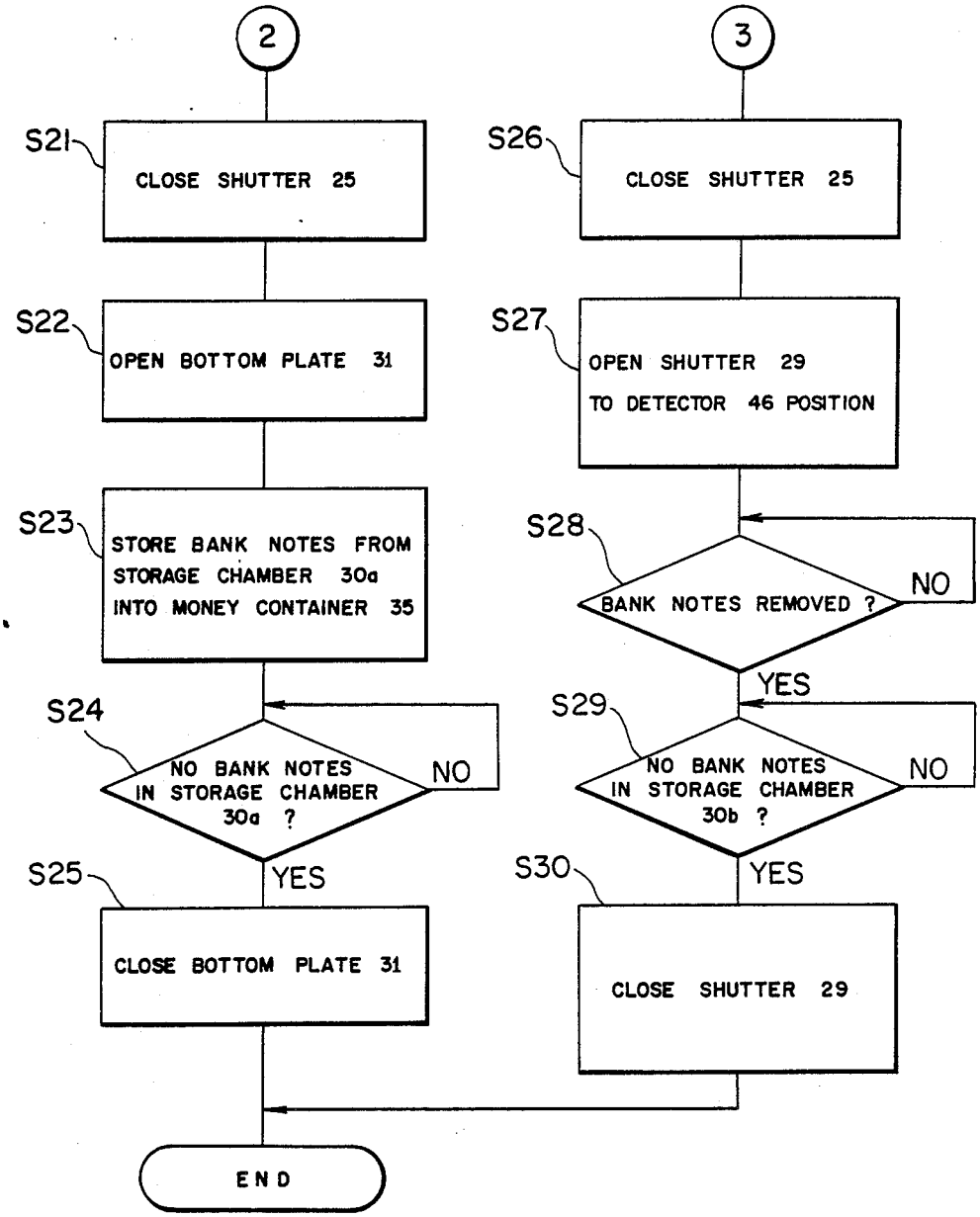
Figure 8:
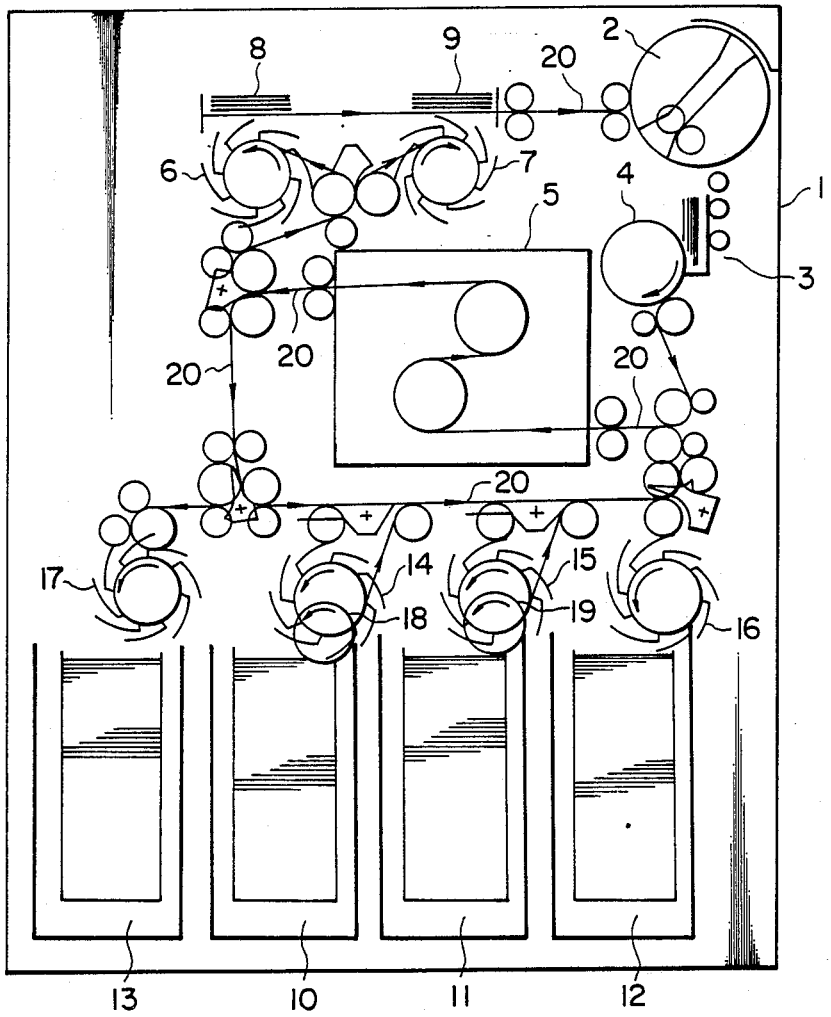
FIG. 8 PRIOR ART
FIG. 8 is a schematic side elevational view showing an internal structure of a conventional automatic monetary transaction machine.

FIGS. 7A and 7B are a flowchart of an operation sequence for a money deposit, which can be executed by the arrangement shown in FIGS. 1 through 6. Now operation of the automatic money depositing apparatus of the present invention will be described with reference to FIGS. 7A and 7B as well as FIGS. 1 through 3.

Step 1: The main controller 51 checks if there are customer's instructions for monetary transaction or not. If not, the main controller 51 keeps on waiting for such customer's instructions for monetary transaction. If there are instructions for a money deposit from a customer, then the main controller 51 controls the sequence guidance indicator 73 for indicating guidance information for the insertion of a cash card and the entry of a password.

When the customer inserts the cash card through the cash card slot 68 and enters the password through the numeric keys 75, customer information including the account number is read from the cash card by the card reader into the main controller 51, which then calls a corresponding password from a file in a central bank database (not shown) and compares this password with the password entered by the customer in order to check the customer and the cash card for their authentic relationship. This checking process may not necessarily be required by monetary deposit transactions.

The customer information is also delivered form the main controller 51 via the interface 52 (FIG. 5) to the control unit 47 in which it is stored in the RAM 50. If the main controller 51 determines that a money deposit is possible, then the main controller 51 instructs the CPU 48 of the control unit 47 via the interface 52 for monetary deposit transaction.

Step 2: The CPU 48 is responsive to the monetary deposit instructions from the main controller 51 for starting to effect the money deposit program stored in the ROM 49, The CPU 48 controls the first shutter driver 53 to open and move the shutter 25 to open the receiver unit 23. When the first shutter position detector 54 applies a signal indicating that the shutter 25 is opened to the CPU 48 in response to an output signal from the sensor 43, the CPU 48 de-energizes the first shutter driver 53 to stop the shutter 25.

The money stocker 26 is now open for allowing the customer to place bank notes via the receiver slot 23 into the money stocker 26.

The main controller 51 is simultaneously responsive to a signal sent from the CPU 48 via the interface 52 for displaying information on the sequence guidance indicator 73 to guide the customer into depositing bank notes.

Step 3: When the bank notes are put into the money stocker 26 by the customer, the sensor associated with the money stocker 26 issues an output signal which is applied to the bank note detector 55 that now detects the deposit of the bank notes. A signal is applied by the bank note detector 55 to the CPU 48 which then instructs the first shutter driver 53 to close the shutter 25.

Step 4: The first shutter driver 53 now closes the shutter 25, and the first shutter position detector 54 then issues a signal indicating that the shutter 25 is closed to the CPU 48 based on an output signal from the sensor 42. The CPU 48 controls the first shutter driver 53 to stop the shutter 25.

At this time, the CPU 48 applies a signal to the bank note presser driver 56 to operate the bank note presser 28 simultaneously with the closing of the shutter 25.

Step 5: In response to the signal from the CPU 48, the bank note presser driver 56 moves the bank note presser 28 in a direction to press the deposited bank notes against a roller of the separator/feeder 27 so that the bank notes will smoothly be separated and fed subsequently.

Step 6: When the bank notes are thus pressed by the bank note presser 28, the CPU 48 energizes the separator/feeder driver 57 to operate the separator/feeder 27 to separate and feed the bank notes one by one from the money stocker 26 into the feed path 34.

Step 7: The feed path 34 is being driven by the first feed path driver 58 which has been energized by the CPU 48 as the same time the separator/feeder driver 57 has been energized by the CPU 48. Therefore, the bank notes are successively delivered along the feed path 34 to the bank note discriminator 32.

Step 8: The bank note discriminator 32 checks if each of the bank notes is true or false, and sends a signal indicative of the result of discrimination to the CPU 48. This checking process also checks whether multiple bank notes are simultaneously delivered or not and whether a bank note is delivered in an inclined posture. The bank note discriminator 32 also identifies the denominations of the bank notes which have been judged as true bank notes, and counts the number of the true bank notes.

In response to the signal from the bank note discriminator 32, the CPU 48 controls the blade driver 59 to operate the swingable switching blade 33 to deliver true bank notes into the storage chamber 30*a* of the temporary storage unit 30 and false bank notes into the storage chamber 30*b* thereof.

The swingable switching blade 33 is normally directed to send bank notes into the storage chamber 30*a*.

Step 9: If a bank note is judged as a true bank note in the step 8, then it is delivered along the feed path 34 and guided by the switching blade 34 into the storage chamber 30*a* where the bank note is stored.

Step 10: If a bank note is judged as a false bank note in the step 8, then the switching blade 33 is turned by the blade driver 59 to change the direction of delivery in the feed path 34.

Step 11: The false bank note is delivered along the feed path 34 and guided by the switching blade 33 into the storage chamber 30*b* where the bank note is stored.

Thereafter, the CPU 48 applies a recovery signal to the blade driver 59 to turn the switching blade back to the original position.

Step 12: The sensor associated with the money stocker 26 continuously checks if there is any bank note left in the money stocker 26. The process from the steps 6 to 11 is repeated as long as bank notes remain in the money stocker 26. When no bank note is left in the money stocker 26, control goes to a next step 13.

Step 13: Upon completion of the counting of the deposited bank notes, the bank note detector 65 detects if there is any false bank note in the temporary storage unit 30 based on an output signal from the sensor associated with the temporary storage unit 30. In response to an output signal from the bank note detector 65, the CPU 48 decides whether there is a false bank note or not. If there is, then control goes to a step 14, and if not, then control goes to a step 19.

Concurrent with this, the CPU 48 instructs the sequence guidance indicator 74 to display the amount of money represented by the counted true bank notes.

Step 14: It is necessary to return any false bank notes to the customer and see if the customer deposits the bank notes again. To this end, the CPU 48 controls the second shutter driver 63 to move the shutter 29 for partly opening the return slot 24.

The second shutter driver 63 moves the shutter 29 to the partly open position, ant the second shutter position detector 64 is responsive to an output signal from the sensor 45 corresponding to the partly open position for supplying the CPU 48 with a signal representing that the shutter 29 is partly open, i.e., the storage chamber **30*b* is open. The CPU 48 then instructs the second shutter driver 64 to stop the shutter 29. At this time, the sequence guidance indicator 73 is instructed by the CPU 48 via the interface 52 and the main controller 51** to display information for guiding the customer into removing any false bank notes.

Step 15: The bank note detector 65 is detecting whether there is a false bank note based on the output signal from the sensor associated with the temporary storage unit 30. When the CPU 48 determines, based on a signal from the bank note detector 65, that any false bank notes are removed by the customer from the storage chamber **30*b* via the return slot 24, the CPU 48 instructs the second shutter driver 63 to close the shutter 29**.

Step 16: The second shutter driver 63 closes the shutter 29, and the closing of the shutter 29 is detected by the second shutter position detector 64 based on an output signal from the sensor 44. The CPU 48 responds to an output signal from the second shutter position detector 64 to control the second shutter driver 63 to stop the shutter 29.

Step 17: Then, the CPU 48 instructs the first shutter driver 53 to open the shutter 25. Based on an output signal from the sensor 43, the first shutter position detector 54 detects the opening of the shutter 25 and applies a signal indicative of the open shutter 25 to the CPU 48, which then disables the shutter driver 53 to stop the shutter 25.

Simultaneously, the sequence guidance indicator 73 is instructed by the CPU 48 through the main controller 51 to display information for guiding the customer into making a decision for depositing bank notes again, or for approval or nonapproval of the money depositing transaction.

The customer now makes such a decision, and deposits bank notes again, or depresses the confirmation key 76 for approval of the transaction, or depresses the cancellation key 77 for nonapproval of the transaction. Dependent on the customer's decision, the following steps 18 through 20 are selectively executed:

Step 18: If the bank note detector 55 detects deposited bank notes in response to an output signal from the non-illustrated sensor on the money stocker 26, then the CPU 48 repeats the routine from the step 4. If no bank note is detected for a certain period of time, then control goes to the step 19.

Step 19: The main controller 51 ascertains whether the confirmation key 76 is depressed or not. If depressed, then the main controller 51 gives a signal indicating that the transaction is effective to the CPU 48, and control goes to a step 21. If not depressed, then control proceeds to the step 20.

Step 20: The main controller 51 ascertains whether the cancellation key 77 is depressed or not. If depressed, then the main controller 51 gives a signal indicating that the transaction is ineffective to the CPU 48, and control goes to a step 26. If not depressed, then the process from the step 18 is repeated.

Step 21: The CPU 48 instructs the first shutter driver 53 to close the shutter 25. Based on an output signal from the sensor 42, the first shutter position detector 54 detects the closing of the shutter 25 and informs the CPU 48, which then de-energizes the first shutter driver 53 to stop the shutter 25.

Step 22: The CPU 48 instructs the bottom plate driver 66 to open the bottom plate 31 of the temporary storage unit 30.

Step 23: At this time, only true bank notes are stored in the storage chamber **30*a*. Therefore, when the bottom plate 31 is opened, the bank notes in the storage chamber 30*a* drop into the money container 35** where they are stored.

Step 24: The bank note detector 65 detects whether there is a bank note left in the storage chamber **30*a* based on an output signal from the non-illustrated sensor. The bank note detector 65 then applies a signal indicating that no bank note is left in the storage chamber 30*a* to the CPU 48**, after which control goes to a step 25:

Step 25: The CPU 48 instructs the bottom plate driver 66 to close the bottom plate 31, whereupon the CPU 48 disables the bottom plate driver 66 to stop the bottom plate 31. The CPU 48 then informs the main controller 51 via the interface 52 of the fact that the money depositing process is completed.

The main controller 51 instructs the card reader to return the cash card which is delivered via the cash card slot 68 to the customer. At the same time, a receipt printed with details (such as the amount of money deposited, the date of the deposit, the balance, etc.) of the money deposit by a printer (not shown) may be issued. If the customer has inserted a passbook through the passbook slot 67, the details of the money deposit are printed on the passbook and thereafter the passbook is returned through the passbook slot 67 to the customer. Thereafter, the apparatus is brought back to the initial condition ready for a next transaction.

If the cancellation key 77 is depressed in the step 20, then control goes to the step 26, as described above.

Step 26: The shutter 25 in the receiver slot 23 is closed.

Step 27: The CPU 48 instructs the second shutter driver 63 to move the shutter 29 to fully open the return slot 24.

Based on an output signal from the sensor 46 corresponding to the fully open position of the shutter 29, the second shutter position detector 64 detects the fully opening of the shutter 29 and applies a signal indicative of the fully opened shutter 29 to the CPU 48. The CPU 48 then de-energizes the second shutter driver 63 to stop the shutter 29.

The temporary storage unit 30 is now fully open to access by the customer who can retrieve all of the bank notes stored in the storage chamber **30*a***.

The CPU 48 simultaneously applies a signal via the interface 52 to the main controller 51 which controls the sequence guidance indicator 73 to display information for guiding the customer into removing the bank notes from the storage chamber **30*a***.

Step 28: When the bank notes are removed by the customer, such removal is detected by the bank note detector 65 based on an output signal from the non-illustrated sensor, and an output signal indicating the detected bank note removal is applied to the CPU 48.

Step 29: For additional confirmation, the bank note detector 65 also detects that no bank note is present in the storage chamber 30*b*, and an output signal representing such bank note absence is sent to the CPU 48.

Step 30: The CPU 48 is responsive to the applied signal for instructing the second shutter driver 63 to close the shutter 29.

When the second shutter position detector 64 detects the closing of the shutter 29 based on an output signal from the sensor 44, an output signal is applied by the second shutter position detector 64 to the CPU 48, which disables the second shutter driver 63 to stop the shutter 29, and also sends a signal indicative of the completion of the bank note returning process to the main controller 51 via the interface 52.

The main controller 51 then instructs the card reader to return the cash card to the customer through the cash card slot 68. Thereafter, the apparatus is initialized in readiness for a next transaction.

Prior to approval by the customer of the money deposit transaction in the above money depositing process, the customer still has a claim for the return of the bank notes being processed in the apparatus. Therefore, should trouble such as a bank note jam occur in the apparatus prior to such approval, it is necessary to give back the customer all of the bank notes belonging to the customer. With the arrangement of the present invention, since the temporary storage unit 30 is positioned near the return slot 24 of the customer access panel 22, the customer can remove the bank notes directly from the temporary storage unit 30. Such bank note retrieval is effected in the following manner:

First, the sequence guidance indicator 73 displays information indicating trouble to the customer. Then, whether bank notes are present in the money stocker 26 is detected. If present, then the shutter 25 is opened to allow the customer to remove the bank notes from the money stocker 26 via the receiver slot 23.

Likewise, whether bank notes are present in the storage chambers 30*a*, 30*b* of the temporary storage unit 30 is detected. If present, then the shutter 29 in the return slot 24 is opened to permit the customer to take out the bank notes from the storage chambers 30*a*, 30*b* via the return slot 24.

Such bank note removal may be indicated on the sequence guidance indicator 73. The above process can automatically be effected under the control of the control unit 47.

The separator/feeder 27, the bank note discriminator 32, and the feed path 34 which are disposed between the money stocker 26 and the temporary storage unit 30 are positioned behind the customer access panel 22 which has the receiver slot 23 and the return slot 24. With this structure, the customer access panel 22 may have an openable portion which can be opened only when trouble occurs in the apparatus to allow the bank note processing route to be open to the customer. Therefore, when trouble happens during a money depositing process, the bank notes being processed can be collected by the customer himself by opening the openable portion of the customer access panel 22. Accordingly, the apparatus can immediately be recovered for normal monetary transactions without involving a substantial downtime.

A process for dispensing bank notes, effected by the automatic money dispensing apparatus combined with the automatic money depositing apparatus of the invention, will be described below. Such a money dispensing process will be described only briefly as it has not direct bearing on the present invention.

The customer depresses the numeric keys 75 to indicate a desired amount of money and desired denominations. Bank notes are correspondingly delivered from the money containers 36, 37 by the bank note feeders 38, 39, respectively, through the feed path 40 into the auxiliary bank note discriminator 41. The auxiliary bank note discriminator 41 checks if the bank notes are accurately delivered out and counts the bank notes. The bank notes are then stacked into the money stocker 26. When the bank notes of the instructed denominations and amount are stacked in the money stocker 26, the shutter 25 is opened to give the customer the bank notes and a notice printed with details (such as the amount of money withdrawn, the date of withdrawal, the balance, etc.) of the dispensing of the bank notes. If a passbook has been inserted through the passbook slot 67, then the details are printed on the passbook.

When bank note delivery trouble such as multiple bank note delivery occurs during the money dispensing process, such trouble is detected by the auxiliary discriminator 41 or other sensor (not shown). The bank notes in question are fed into the money stocker 26, from which they are delivered through the separator/feeder 27, the bank note discriminator 32, the feed path 34, and the temporary storage unit 30 back into the money container 35. During this time, the bank note discriminator 32 remains inoperative, and the shutter 29 remains closed.

Thus, any bank notes in trouble are processed without intervention by the customer. After the apparatus is reinstated for proper operation, a money dispensing process is started again for a normal monetary transaction.

The above operation can be effected by controlling the bank note discriminator 32, the auxiliary bank note discriminator 41, and the various drivers and detectors 53–66.

While the above embodiment has been described as being incorporated in the automatic money depositing apparatus combined with the automatic money dispensing apparatus in the automatic monetary transaction machine, the principles of the present invention are also applicable to an automatic money depositing apparatus only, and also an apparatus which handles coins rather than bank notes.

Although a certain preferred embodiment has been shown and described, it should be understood that many changes and modifications may be made therein without departing from the scope of the appended claims.

What is claimed is:

1. An automatic money depositing apparatus comprising:

a customer access panel having a receiver slot for receiving moneys deposited by a customer and a return slot for returning moneys deposited by the customer;

a separator/feeder means for separating and feeding the moneys one by one which have been received through said receiver slot;

a discriminator means for checking whether the moneys fed by said separator/feeder means are true or false and for identifying denominations of said moneys;

a temporary storage unit for temporarily storing true and false moneys separately, said temporary storage unit being located adjacent to said return slot and said separator/feeder means and said discriminator means being disposed behind said customer access panel and said separator/feeder means, said discriminator means, and said temporary storage unit are disposed behind said customer access panel and directed horizontally in rightward and leftward directions relative to the customer;

a money container for storing the true moneys delivered from said temporary storage unit;

an input means operable by the customer to indicate approval or nonapproval of a money deposit made by the customer through said receiver slot; and a control means for opening said return slot to allow the customer to remove the money directly from said temporary storage unit when the money is returning to the customer, and for opening at least one of said receiver slot and said return slot to allow the customer to remove the money remained in said depositing apparatus directly from depositing apparatus when a jammed note occurs in said depositing apparatus before the indication of approval or nonapproval of the money deposit is made by the customer.

2. An automatic money depositing apparatus according to claim 1, wherein said control means includes means for storing the moneys from said temporary storage unit into said money container in response to operation of said input means indictive of approval of the money deposit and wherein said money container is disposed just under said storage unit and the bank note is directly housed in the money container from the temporary storage unit by horizontally sliding the bottom plate.

3. An automatic money dispensing apparatus comprising:

a customer access panel having a receiver slot for receiving moneys deposited by a customer and a return slot for returning moneys deposited by the customer;

a first shutter for selectively opening and closing said receiver slot and a second shutter for selectively opening and closing said return slot;

separator/feeder means for separating and feeding the moneys one by one which have been received through said receiver slot;

discriminator means for checking whether the moneys fed by said separator/feeder means are true or false and identifying denominations of said moneys, said separator/feeder means and said discriminator means being disposed behind said customer access panel;

a temporary storage unit for temporarily storing true and false moneys separately, said temporary storage unit being located adjacent to said return slot;

a money container for storing the true moneys delivered from said temporary storage unit;

input means operable by the customer to indicate approval or nonapproval of a money deposit made by the customer through said receiver slot; and control means for automatically opening said second shutter to a first degree to return only the false moneys from said temporary storage unit through said return slot to the customer, and for opening said second shutter to a second degree different from said first degree to return all the deposited moneys from said temporary storage unit through said return slot to the customer in response to operation of said input means indicative of nonapproval of the money deposit.

* * * * *